United States Patent [19]

Bianchini et al.

[11] Patent Number: 4,835,884

[45] Date of Patent: Jun. 6, 1989

[54] SHOE STRUCTURE

[75] Inventors: William L. Bianchini, Elmwood; Robert Infantino, Newton, both of Mass.; Vicent Musarra, Fort St. Lucie, Fla.

[73] Assignee: The Rockport Company, Marlboro, Mass.

[21] Appl. No.: 179,363

[22] Filed: Apr. 8, 1988

[51] Int. Cl.[4] ..... A43B 13/40; A43B 13/14

[52] U.S. Cl. ..... 36/24.5; 36/108

[58] Field of Search ..... 36/24.5, 34 R, 37, 38, 36/43, 69, 76 R, 76 C, 76 HH, 82, 107, 108

[56] References Cited

U.S. PATENT DOCUMENTS

| | | | |
|---|---|---|---|
| 482,561 | 9/1892 | Parkinson . | |
| 1,356,829 | 10/1920 | Rohmer . | |
| 1,717,122 | 6/1929 | Schaff . | |
| 1,724,349 | 8/1929 | Haag . | |
| 1,995,831 | 3/1935 | Baynard . | |
| 2,074,050 | 3/1937 | Dwyer | 36/37 X |
| 2,083,581 | 6/1937 | Silver . | |
| 2,176,684 | 10/1939 | Quirk | 36/24.5 X |
| 2,350,362 | 6/1944 | Margolin . | |
| 2,772,488 | 12/1956 | Meltzer | 36/37 X |
| 2,901,841 | 9/1959 | Joiner et al. . | |
| 2,912,772 | 11/1959 | Harrison . | |
| 3,099,096 | 7/1963 | Fabian . | |
| 3,475,837 | 11/1969 | Garcia . | |
| 4,320,588 | 3/1982 | Sottolana . | |
| 4,674,202 | 6/1987 | Bourque | 36/76 R X |
| 4,783,910 | 11/1988 | Boys et al. | 36/108 X |

FOREIGN PATENT DOCUMENTS

| | | |
|---|---|---|
| 917582 | 2/1963 | United Kingdom . |
| 1093363 | 11/1967 | United Kingdom . |

*Primary Examiner*—Donald Watkins

*Attorney, Agent, or Firm*—Saidman, Sterne, Kessler & Goldstein

[57] ABSTRACT

A shoe structure which provides a comfortable, lightweight, strong and stable support structure which provides cushioning and shock absorption in the heel and a smooth transition from the midfoot to the forefoot for a high heel shoe. The shoe structure comprises a molded shank member having a midfoot portion and a heel portion having an integrally formed basket for receiving a heel pad, a shank stiffener embedded in the shank member, and an insole board having a forefoot portion and a midfoot portion, the midfoot portion having upper and lower layers between which the midfoot portion of the molded shank member is enclosed.

16 Claims, 2 Drawing Sheets

SHOE STRUCTURE

BACKGROUND OF THE INVENTION

1. Field of the Invention

The present invention relates generally to an improved shoe structure and, more particularly, is directed towards an improved shoe structure for a high heel shoe.

2. Description of Related Art

The ideal shoe design attempts to incorporate the following essential features: comfort, lightweight, stability, support, flexibility, cushioning and shock absorption. Lightweight is an essential feature since it facilitates movement and minimizes fatigue of the wearer. Stability and support are necessary to provide proper foot support and to prevent injuries to the wearer. Flexibility allows the foot of the wearer to easily bend and move, thereby increasing comfort and reducing fatigue. Shock absorption and cushioning not only enhance comfort, but protect the skeletal system from the adverse effects of the repeated impact forces encountered in walking, especially in hard heels. Fashion and style also influence the design of a shoe.

None of the prior shoe constructions have been able to successfully combine these features. Prior attempts have been unsuccessful largely because prior shoes have emphasized one of the above-noted features to the detriment of others. Furthermore these prior attempts to construct such a shoe have not only failed to consider the importance of industrialized construction, but have failed to consider fashion and style.

The problems enumerated above are particularly acute in high heel shoes and even more acute in women's dress high heel shoes wherein the shoe construction is further limited by size and space constraints as dictated by fashion. The need therefore exists for a shoe structure, particularly for a high heel shoe, which effectively provides shock absorption, cushions the foot of the wearer, provides support and stability to the heel and midfoot area of the foot and adequately accommodates the flexing of the forefoot of the wearer, while still satisfying the demands for comfort, fashion and style. Furthermore, the structure needs to lend itself to modern manufacturing methods.

One prior attempt to provide shock absorption in high heel shoes has been to provide a recess in the heel for receiving a heel pad. However, such construction fails to provide a strong lightweight structure for providing support to the arch and midfoot area of the foot. The construction of prior art shoes, therefore, renders the wearer vulnerable to injury and fatigue. Many prior art shoes utilize supports for the midfoot area which are constructed of metal and plastic, however, none of these prior art supports offer lightweight construction in combination with high strength. Furthermore, a smooth transition from the midfoot area to the forefoot area is generally not achieved, thereby decreasing comfort and stability.

Accordingly, it may be appreciated that prior art shoes, especially high heel shoes, are deficient in meeting optimum or even acceptable levels of weight, stability, support, shock absorption, cushioning, flexibility and comfort. The present invention has satisfied these criteria by providing a unique shoe structure having a lightweight, strong and stable support structure which incorporates a heel pad offering excellent shock absorption and having a smooth transition from the midfoot area to the forefoot area for a comfortable fashionable high heel shoe.

SUMMARY OF THE INVENTION

It is an object of the present invention to provide a comfortable high heel shoe with a structure which is lightweight, strong, stable and provides shock absorption and cushioning.

It is another object of the present invention to provide a high heel shoe structure having a smooth transition from the midfoot area to the forefoot area.

It is another object of the present invention to provide a high heel shoe structure suitable for women's dress high heel shoes.

In accordance with the present invention, a shoe structure is provided comprising a shank member having a midfoot portion and a heel portion having an integrally formed basket for receiving a heel pad, a shank stiffener embedded in the shank member, and a two-layer insole board having a forefoot portion and a midfoot portion. The midfoot portion has upper and lower layers between which the midfoot portion of the shank member is enclosed.

The shank member may be constructed of plastic and the shank stiffener may be constructed of metal. The shank stiffener may also include ribs for enhancing structural rigidity and may conform substantially to the shape of the shank member and the basket. To provide a gradual transition between the midfoot and forefoot portion of the shank member, the shank member has a tapered forward edge which, to allow forefoot flexibility, extends to a point rearward of a line between the first and fifth metatarsal heads. The shank member is also preferably stepped at the boundary between the midfoot portion and the heel portion such that the upper layer of the insole board extends to the step and abuts the vertical face of the step so as to provide a continuous surface between the heel portion of the shank member and the midfoot portion of the shank member enclosed by the insole board. The shank member may also have a bevelled edge formed about its periphery.

The heel pad is preferably substantially frustroconical and may be integral with an insole cushion which can be provided above the shank member and insole board.

The basket and shank stiffener are adapted for fastening to the heel, usually by means of a fastener passing through a hole in the bottom of the basket and through the shank stiffener.

For a better understanding of the present invention, together with other objects, reference is made to the following description, taken in conjunction with the accompanying drawings. The scope of the present invention will be pointed out in the claims.

DETAILED DESCRIPTION OF THE PREFERRED EMBODIMENT

Figure 1:
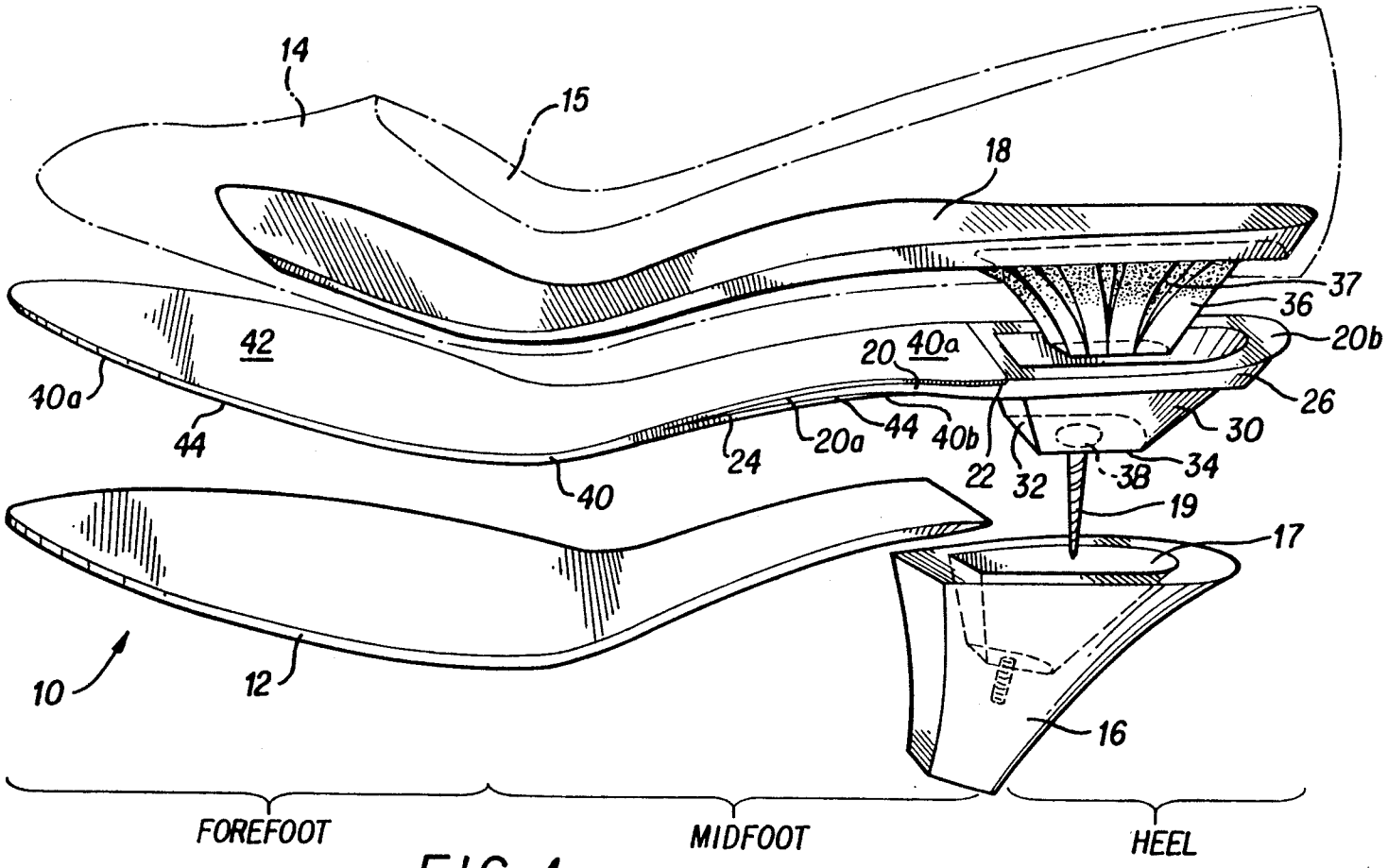
FIG. 1 is an exploded schematic view of a shoe incorporating a structure according to the present invention.

The present invention overcomes the aforementioned problems and deficiencies in the prior art by providing a novel shoe structure that advantageously combines lightweight, stability, support, cushioning, shock absorption and flexibility and comfort. Referring now to the drawings, wherein like reference characters represent identical or corresponding parts throughout the several views, and more particularly to FIG. 1, reference character 10 generally indicates a shoe incorporating the preferred embodiment of the present invention. Although the present invention may be utilized in a variety of shoe types, FIGS. 1–3 illustrate a high heel shoe and the preferred embodiment for the high heel shoe.

A shoe 10 has an upper 14 which is secured to a peripheral portion of the top surface of an outsole 12 and a peripheral portion of the top surface of a heel 16. Upper 14, outsole 12 and heel 16 are also secured to an insole board 40 and a shank member 20. The border between upper 14 and outsole 12 is the lasting margin. Shoe 10 also comprises an insole cushion 18 located inside upper 14 and overlying shank member 20 and insole board 40. Insole cushion 18 contributes to shock absorption and cushioning and may be fashioned from a variety of materials, such as polyurethane or ethylene vinyl acetate (EVA), having the desired properties of impact dampening and resiliency. In the preferred embodiment, insole cushion 18 is molded from the lowest density polyurethane possible. Insole cushion 18 may also be formed so as to have a concavity to its upper surface, particularly in the heel portion, so as to provide a "cup" or cradle for receiving the foot of the wearer. As is generally known in the art, additional cushioning and sock lining material may overlay insole cushion 18 or be integrally formed therewith.

Shank member 20 and insole board 40 form the structural frame upon which shoe 10 is constructed. Shank member 20 and insole board 40 provide a stable and comfortable platform for the foot of the wearer and also provide a structure for securing heel 16, outsole 12 and upper 14. Shank member 20 and insole board 40 also provide the shape and contour of shoe 10.

Figure 2:
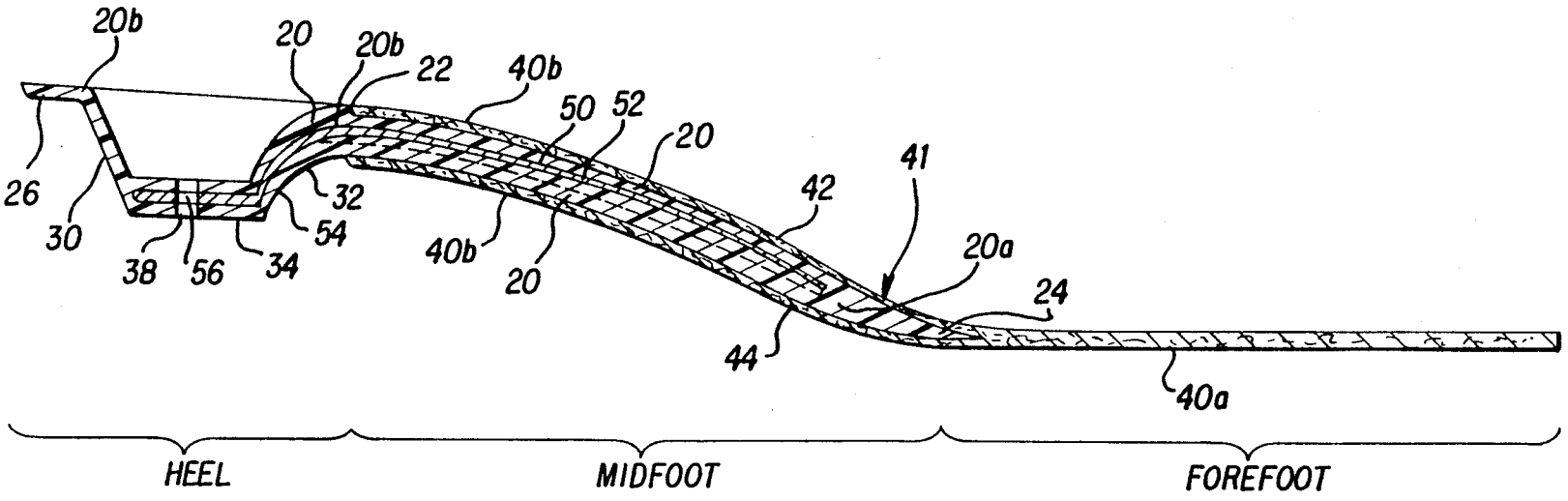
FIG. 2 is a longitudinal cross-section view, taken along a substantially central longitudinal line, of the shoe structure of FIG. 1 assembled.
Figure 3:
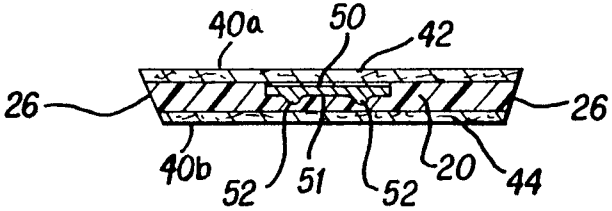
FIG. 3 is a transverse, cross-section view, taken along a substantially central transverse line, of the shoe structure of FIG. 1 assembled.

Shank member 20, as shown in FIGS. 1 and 2, has a midfoot portion **20*a* and a heel portion 20*b*. Shank member 20 may also have a concave upper surface, particularly in heel portion 20*b* so as to provide a "cup" or cradle for receiving the foot of the wearer. Insole board 40 has a forefoot portion 40*a* and a midfoot portion 40*b*. The forward edge of midfoot portion 20*a* of shank member 20 has a taper 24 that gradually decreases in thickness, measured from the top surface to the bottom surface. Taper 24 smoothes the transition from midfoot portion 20*a* of shank member 20 to the forefoot portion 40*a* of insole board 40**. By providing a gradual decrease in thickness, a smooth transition is achieved which results in greater comfort for the wearer.

In the preferred embodiment of the invention, the forward edge of midfoot portion **20*a* of shank member 20 may extend up to, but not over, what is known in the art as the "flexline." The flexline is generally considered as a line between the first and fifth metatarsal heads of the foot. This line in the forefoot is generally located where the majority of bending occurs during walking. To avoid interfering with the normal motion of the foot of the wearer and to obtain maximum flexibility, taper 24 of shank member 20 does not extend past the flexline. In FIG. 2 shank member 20** is shown terminating rearwardly of the flexline.

In order to provide shock absorption, that is, to protect the foot of the wearer from the impact forces of walking, particularly at heel strike, shank member 20 has, in heel portion **20*b*, an integral basket 30 for receiving a heel pad 36. Basket 30 has a front wall 32 and a bottom 34. In the preferred embodiment, basket 30 is shaped so as to generally conform to the contour and size of heel pad 36. A hole 38 is provided in the bottom 34 of basket 30 through which a fastener 19 may be inserted to secure shank member 20 to heel 16. Fastener 19 may be a screw, rivet, nail, other fastener, or a plurality thereof. Adhesives or any other type of fastener may also be employed. Heel 16 is provided with a cavity 17 for receiving basket 30. In the preferred embodiment, cavity 17 substantially conforms in size and shape to the external surface of basket 30** so as to provide a large amount of abutting surface area to thereby enhance the structural integrity of the fastened elements.

Heel pad 36 may assume a variety of shapes, however, in the preferred embodiment of the present invention, heel pad 36 is shaped substantially frustroconical and oriented with its base at the top and basket 30 has a complementary shape to receive heel pad 36. This provides a high degree of shock absorption in the central portion under the calcis bone and it provides a progressively increasing degree of shock absorption from the periphery towards the central portion of heel pad 36 and basket 30. That is, because the depth of basket 30 and heel pad 36 increases from the edge to the center, a greater amount of shock absorption is provided at the center of basket 30 and heel pad 36 as compared to the periphery of basket 30 and heel pad 36. The location of heel cushion 36 under the calcis bone also helps prevent the foot of the wearer from sliding forward in shoe 10 and thus further enhances the comfort of the wearer. The frustroconical shape also provides a secure fit for heel pad 36 in basket 30.

Heel pad 36 may be attached to insole cushion 18 or integrally formed with insole cushion 18 or inserted into basket 30 as a separate component. Heel pad 36 may also be provided with a plurality of sculptured recesses 37 about the side of frustroconical heel pad 36 as shown in FIG. 1. Recesses 37 enhance the performance of heel pad 36, particularly by allowing for the deformation of heel pad 36 under load. Many different materials can be utilized for heel pad 36. However, VISCOLITE has been found to have desirable properties, particularly with respect to shock absorption, for use as heel pad 36.

As shown in FIG. 2, shank member 20 may also have an embedded shank stiffener 50 for increasing the rigidity of shank member 20. Preferably, shank member 20 is molded about shank stiffener 50. This simplifies construction because shank stiffener 50 may be placed in a mold for forming shank member 20. Thus, shank member 20 may be formed with shank stiffener 50 in situ. This provides for a secure and permanent attachment of shank member 20 to shank stiffener 50. Obviously, shank stiffener 50 can be secured in some other fashion. Shank stiffener 50 is generally constructed of metal, although other materials, such as high strength plastics and fiber composite materials, are contemplated for use as a shank stiffener. As shown in FIGS. 2 and 3, shank stiffener 50 may also comprise ribs 52, extending longitudinally along a lower surface 51 of shank stiffener 50 to increase its structural rigidity.

In the preferred embodiment and as shown in FIG. 3, shank stiffener 50 is narrower measured transversely than shank member 20 and extends longitudinally along the central portion of shank member 20. As shown in FIG. 2, the rear portion of shank stiffener 50 is shaped so as to conform to the shape of basket 30, extending from the middle portion of shank member 20, down the inside of front wall 32 of basket 30 and across the inside of bottom 34 of basket 30. This structure substantially reinforces shank member 20 and provides the basis for the necessary structural rigidity of the assembled heel 16 and shank member 20. Shank stiffener 50 may include a hole 56 in alignment with hole 38 in basket 30 through which fastener 19 may be inserted to secure shank member 20 to heel 16.

Referring back to FIG. 1, the present invention provides an insole board 40 which together with shank member 20 establishes the bottom inside surface 41 of the interior of shoe 10. Insole boards are generally well known in the art and are usually constructed of TEXON or a fibrous material such as paper board.

As discussed above, insole board 40 has a forefoot portion 40*a* and a midfoot portion 40*b*. Midfoot portion 40*b* has an upper layer 42 and a lower layer 44. The midfoot portion 20*a* of shank member 20 is enclosed between upper layer 42 and lower layer 44 of insole board 40 so as to integrate the two components. Adhesive may be used to secure the layers of insole board 40 to shank member 20 although other means of securing the components should be apparent to those skilled in the art. Alternately, in constructing a shoe structure according to the invention, preformed shank member 20 may be placed in a mold with insole board 40 such that midfoot portion 20*a* of shank member 20 is enclosed between upper layer 42 and lower layer 44 of insole board 40. The mold is then closed and pressure applied to make insole board 40 closely conform to shank member 20. Heat may also be used in this process.

Forefoot portion 40*a* of insole board 40 extends forward of the forward edge of midfoot portion 20*a* of shank member 20 and generally covers the entire inside bottom surface 41 of the forefoot region of shoe 10 (FIG. 2).

One of the attendant advantages of this configuration wherein insole board 40 and shank member 20 are integrated is that a continuous unitary platform with no noticeable breaks is formed. Insole cushion 18 and/or a sock liner is generally provided over the unitary platform comprised of shank member 20 and insole board 40. Insole board 40 and shank member 20 define the horizontal contour and shape of shoe 10. Consequently, upper 14 partially wraps around the bottom surface of shank member 20/insole board 40 and then extends upward from the lasting margin such that the periphery of shank member 20 and insole board 40 abuts the interior surface of upper 14. The bottom edges of upper 14 are secured between shank member 20/insole board 40 and outsole 12. Shank member 20 has a contoured or bevelled edge 26 about its periphery to provide a less severe angle for upper 14 extending from the lasting margin to turn.

As shown in FIG. 2, a step 22 is provided in the upper surface of shank member 20 at the junction of basket 30 to provide a smooth transition from upper layer 42 of insole board 40 to heel portion 20*b* of shank member 20. Upper layer 42 of insole board 40 abuts the vertical surface of step 22 so that the top surface of midfoot portion 40*b* of insole board 40 is flush with the top surface of heel portion 20*b* of shank member 20. By providing step 22, a continuous unitary platform is provided.

While the shoe construction according to the invention has been described with regard to a woman's high heel shoe, numerous modifications and variations of the present invention are possible which could be applied to general footwear or to other specialized forms of footwear.

What is claimed is:

1. A shoe structure for a high heel shoe, said shoe structure comprising:

a shank member having a midfoot portion and a heel portion;

a heel pad;

a basket for receiving said heel pad, said basket integral with said heel portion of said shank member;

a shank stiffener embedded in said shank member; and a two-layer insole board having a forefoot portion and a midfoot portion, said midfoot portion of said insole board having an upper layer and a lower layer wherein said midfoot portion of said shank member is enclosed between said upper layer and said lower layer of said insole board.

2. The shoe structure of claim 1, wherein said shank member is plastic.

3. The shoe structure of claim 1, wherein said shank stiffener is metal.

4. The shoe structure of claim 3, wherein said shank stiffener further comprises ribs for enhancing structural rigidity.

5. The shoe structure of claim 3, wherein said shank stiffener conforms substantially to the shape of said shank member and said basket.

6. The shoe structure of claim 1, wherein said shank member further comprises a step at the boundary between said midfoot portion and said heel portion of said shank member such that said upper layer of said insole board extends to said step and abuts the vertical face of said step such that a continuous surface is formed between said heel portion of said shank member and said midfoot portion of said shank member.

7. The shoe structure of claim 1, wherein said shank member further comprises a tapered portion at a forward edge of said midfoot portion such that a gradual transition is provided between said midfoot portion of said shank member and said insole board in the forefoot portion.

8. The shoe structure of claim 1, wherein said shank member further comprises a beveled edge formed about its periphery.

9. The shoe structure of claim 1, wherein said midfoot portion of said shank member extends to a point rearward of a line between the first and fifth metatarsal heads of the foot.

10. The shoe structure of claim 1, wherein said heel pad is substantially frustroconical.

11. The shoe structure of claim 10, wherein said heel pad further comprises recesses to allow deformation of said heel pad under load.

12. The shoe structure of claim 1, further comprising an insole cushion disposed above said shank member and said insole board.

13. The shoe structure of claim 12, wherein said heel pad is integral with said insole cushion.

14. The shoe structure of claim 1, wherein said basket further comprises an opening to accommodate a fastener to secure said shank member to a heel.

15. The shoe structure of claim 14, wherein said stiffener comprises an opening to accommodate a fastener to secure said shank member to a heel.

16. A shoe, comprising:

an outsole;

an upper secured to said outsole;

a heel secured to said upper and said outsole;

a shank member having a midfoot portion and a heel portion;

a heel pad;

a basket for receiving said heel pad, said basket integral with said heel portion of said shank member;

a shank stiffener embedded in said shank member; and a two-layer insole board having a forefoot portion and a midfoot portion, said midfoot portion of said insole board having an upper layer and a lower layer wherein said midfoot portion of said shank member is enclosed between said upper layer and said lower layer of said insole board.

* * * * *